US007544894B2

(12) United States Patent
Victor

(10) Patent No.: US 7,544,894 B2
(45) Date of Patent: Jun. 9, 2009

(54) CABLE STRUCTURE

(76) Inventor: Jay Victor, 2017 Bataen Rd., Unit A, Redondo Beach, CA (US) 90278

( * ) Notice: Subject to any disclaimer, the term of this patent is extended or adjusted under 35 U.S.C. 154(b) by 0 days.

(21) Appl. No.: 11/926,428

(22) Filed: Oct. 29, 2007

(65) Prior Publication Data

US 2009/0107695 A1 Apr. 30, 2009

(51) Int. Cl.
*H01B 11/02* (2006.01)

(52) U.S. Cl. ..... 174/113 R

(58) Field of Classification Search ..... 174/113 R, 174/102 R, 106 R, 102 SC, 120 SC
See application file for complete search history.

(56) References Cited

U.S. PATENT DOCUMENTS 5,334,271 A 8/1994 Bullock et al.
5,495,212 A 2/1996 DeCramer
5,864,094 A * 1/1999 Griffin ..... 174/105 R
6,388,188 B1 5/2002 Harrison
7,060,905 B1 * 6/2006 McMahon ..... 174/110 R
7,420,123 B2 * 9/2008 Klotz ..... 174/120 R

* cited by examiner

*Primary Examiner*—Chau N Nguyen
(74) *Attorney, Agent, or Firm*—Trojan Law Offices

(57) ABSTRACT

A cable providing noise rejection in a wide frequency range. A cable has an inner section, an outer section and a jacket. The inner section may contain one or more core conductors that are surrounded by a common insulation, which is surrounded by a shield. The outer section contains one or more pairs of outer conductors that are positioned around the inner section. In each pair of outer conductors, the outer conductors are positioned 180° from each other. The outer conductors may be located parallel to the central axis of the inner section. In another embodiment of the present invention, the outer conductors spirally wind around the inner section while substantially maintaining their relative positions.

20 Claims, 5 Drawing Sheets

CABLE STRUCTURE

BACKGROUND OF THE INVENTION

1. Field of the Invention

The invention herein relates to a cable, specifically an improved structure cable providing noise rejection in a wide frequency range.

2. Description of the Prior Art

Two well-known cable structures are a coaxial cable and a twisted pair cable. A coaxial cable usually consists of a core conductor, a dielectric insulator, and a conducting shield, which is usually surrounded by a jacket. The core conductor of a coaxial cable is surrounded by a dielectric insulator, which is surrounded by a conducting shield. A coaxial cable provides the best noise reduction in high frequencies.

In a twisted pair cable, two conductors are wound together. The two conductors typically carry equal and opposite signals, and the noises from the two conductors cancel each other since the two conductors are exposed to similar electromagnetic interference. The best noise reduction in a twisted pair cable occurs in low frequencies.

SUMMARY OF THE INVENTION

The objective of the invention herein is to provide an improved structure cable allowing noise rejection in a wide frequency range.

To achieve the objective, a cable comprises an inner section, an outer section and a jacket. The inner section comprises a core conductor having a central axis, an insulation, and a first shield. The core conductor is surrounded by the insulation, and the insulation is surrounded by the first shield. The inner section may further comprise a second shield, which surrounds the first shield. The impedance of the inner section is preferably in the range of approximately 75 ohms to approximately 110 ohms. The outer section comprises one or more pairs of outer conductors that are positioned around the inner section. In each pair of outer conductors, the outer conductors may be located parallel to the central axis of the inner section such that the outer conductors are positioned 180° from each other. In another embodiment of the present invention, in each pair of outer conductors, the outer conductors are positioned 180° from each other and spirally wind around the inner section while maintaining their respective positions of 180° from each other. When more than one pair of outer conductors are utilized, the multiple pairs of outer conductors spirally wind around the inner section while substantially maintaining their relative positions. One or more fillers may also be positioned around the inner section to maintain the substantially circular shape of the outer extent of the outer section. The outer section is encased by a jacket. The outer section may be surrounded by a third shield, which is then surrounded by the jacket.

In still another embodiment of the present invention, a cable can comprise a bundle of core conductors in the inner section, instead of a single core conductor. The bundle of core conductors are arrayed in parallel along the core axis of the cable and surrounded by a common insulation. The number of core conductors in the bundle can vary, and the outer extent of the bundle of core conductors maintains substantially circular in shape. Core conductors of the bundle may have substantially the same cross-sectional shape and size. In another embodiment, the bundle of core conductors may comprise at least two different types of conductors. Preferably, the inner section of the cable is constructed such that the impedance of the inner section is in the range of approximately 75 ohms to approximately 110 ohms. The remaining structure of the cable comprising a bundle of core conductors can be constructed in the same way as the structure of the counterparts in the cable comprising a single core conductor.

DETAILED DESCRIPTION OF THE INVENTION

Figure 1:
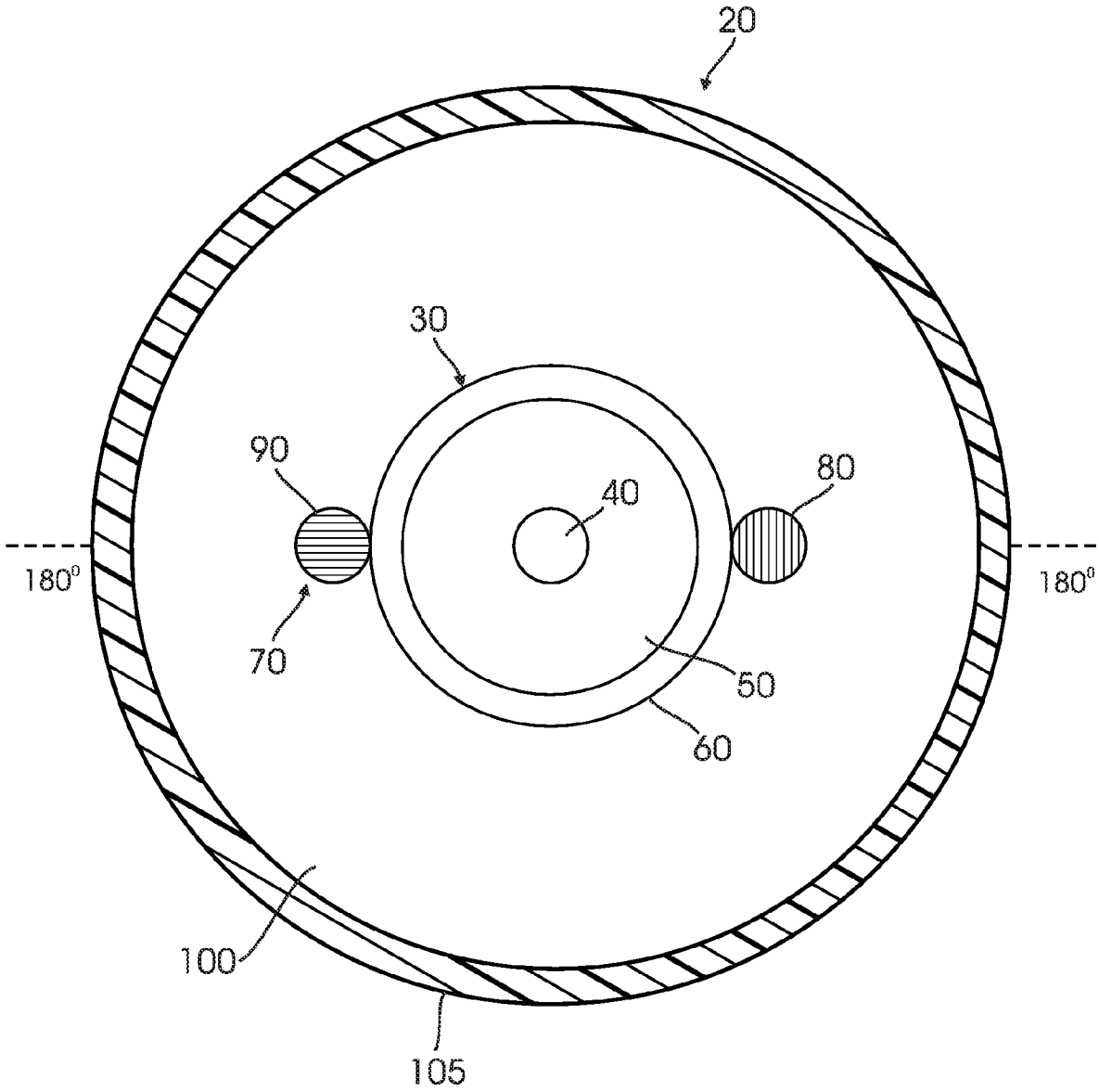
FIG. 1 is a cross-sectional drawing of an embodiment of the invention herein.
Figure 3:
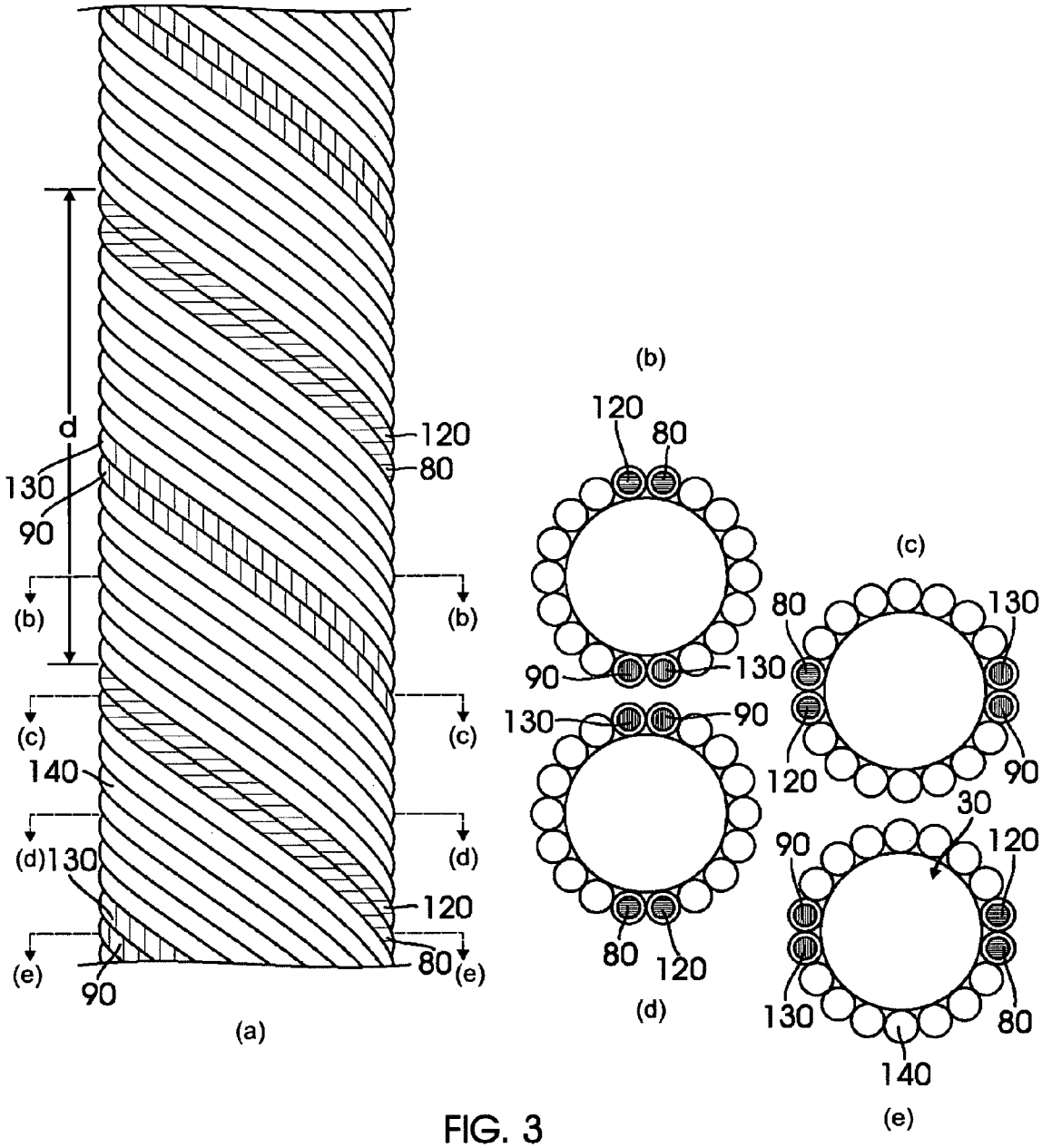
FIG. 3 is a schematic diagram of an embodiment of the present invention comprising two pairs of outer conductors.

FIG. 1 illustrates a first embodiment of the present invention. A cable 20 in FIG. 1 comprises an inner section 30, an outer section 70, and a jacket 100. The inner section 30 of the cable 20 comprises a core conductor 40 having a central axis, an insulation 50, and a first shield 60. The core conductor 40 is surrounded by the insulation 50, and the insulation 50 is surrounded by the first shield 60. The outer section 70 of the cable 20 comprises a pair of outer conductors that are a first outer conductor 80 and a second outer conductor 90. The outer conductors 80, 90 are positioned around the inner section 30 such that the outer conductors 80, 90 are positioned 180° from each other as shown by a broken line in FIG. 1. The outer conductors 80, 90 may be located parallel to the axis of the inner section 30. In another embodiment of the present invention, the outer conductors 80, 90 spirally wind around the inner section 30 while maintaining their respective positions of 180° from each other. The greater the number of spiral windings is (i.e., the shorter the distance from the start to the end of a single winding as shown as d in FIG. 3 is), the greater noise rejection is. Each of the outer conductors 80, 90 may or may not be individually insulated. The jacket 100 surrounds the outer section 70, thereby enclosing the inner section 30 and the outer section 70.

Figure 2:
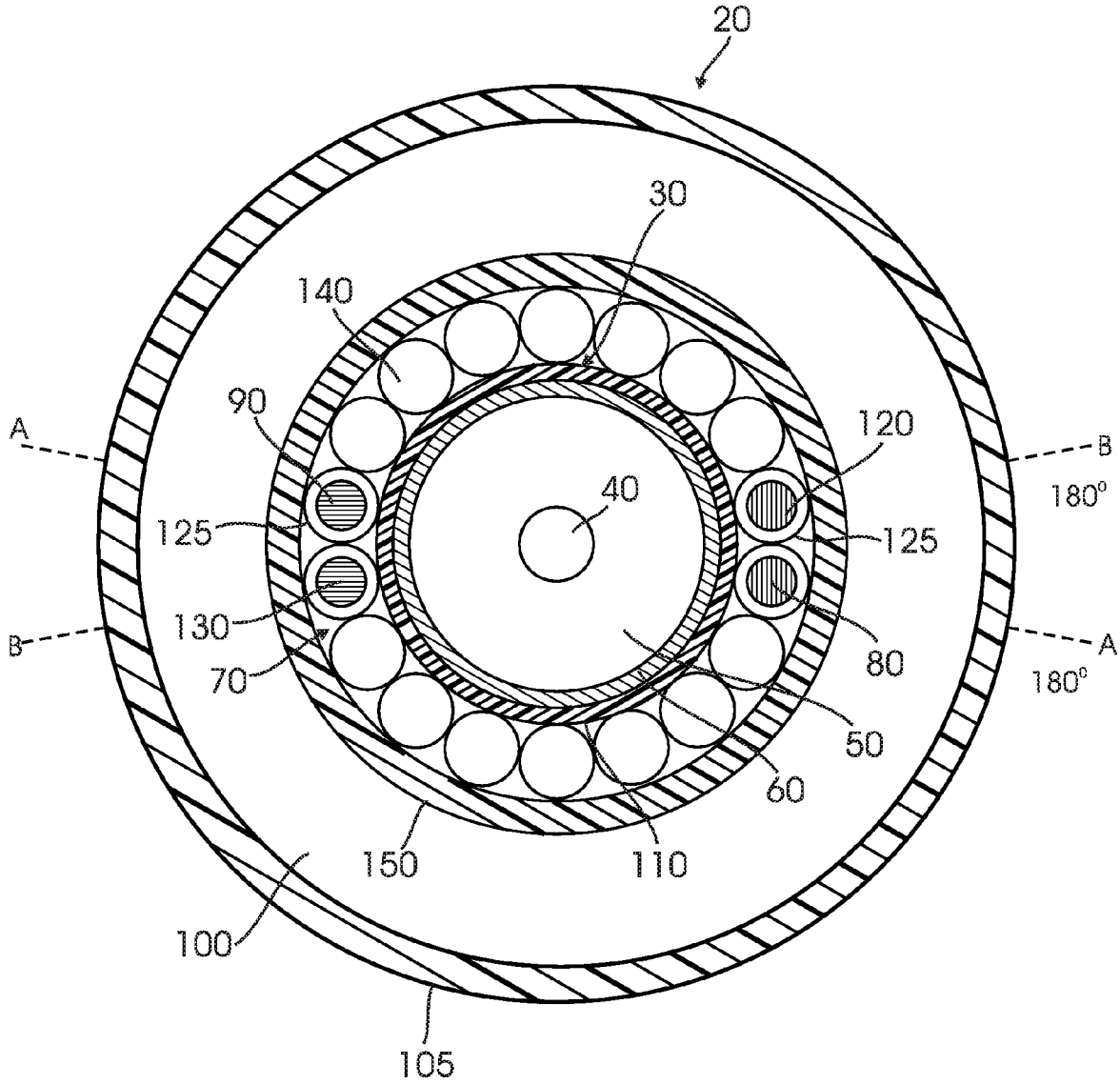
FIG. 2 is a cross-sectional drawing of another embodiment of the invention herein.

The cable 20 may further comprise a second shield 110 that surrounds the first shield 60 as shown in FIG. 2. Also, the cable 20 may further comprise a third shield 150 that surrounds the outer section 70 and that is surrounded by the jacket 100 as illustrated in FIG. 2. FIG. 2 shows another embodiment of the present invention, wherein the outer section 70 of the cable 20 further comprises a second pair of outer conductors that are a third outer conductor 120 and a fourth outer conductor 130. Preferably, each of the first outer conductor 80, the second outer conductor 90, the third outer conductor 120, and the fourth outer conductor 130 is individually insulated with a dielectric 125. The insulated third outer conductor 120 is positioned around the inner section 30 between the insulated first outer conductor 80 and the insulated second outer conductor 90. The insulated fourth outer conductor 130 is positioned 180° from the insulated third outer conductor 120 as shown by a broken line B-B in FIG. 2, where the insulated first outer conductor 80 is positioned 180° from the insulated second outer conductor 90 as shown by a broken line A-A in FIG. 2. One or more fillers 140 may be positioned next to the insulated outer conductors 80, 90, 120, and 130 around the inner section 30 to maintain the substantially circular shape of the outer extent of the outer section 70. The insulated first, second, third, and fourth outer conductors

80, 90, 120, and 130 and the fillers 140 may be located parallel to the central axis of the inner section 30. In another embodiment of the present invention, the insulated first, second, third, and fourth outer conductors 80, 90, 120, and 130 and the fillers 140 spirally wind around the inner section 30 while substantially maintaining their relative positions.

FIG. 3 illustrates the relative positions of the insulated first, second, third, and fourth outer conductors 80, 90, 120, and 130 and the fillers 140 that spirally wind around the inner section 30 along the cable. In particular, FIG. 3(*b*) through (*e*) show such relative positions in the cross section of the cable at a series of positions along the cable as indicated in FIG. 3(*a*). The detailed structure of the inner section 30 is omitted in FIG. 3(*b*) through (*e*). As shown in FIG. 3, the insulated outer conductors and the fillers spirally wind around the inner section 30 with a substantially equal winding angle and winding distance d so that their relative positions are substantially maintained while they spirally wind along the cable.

Figure 4:
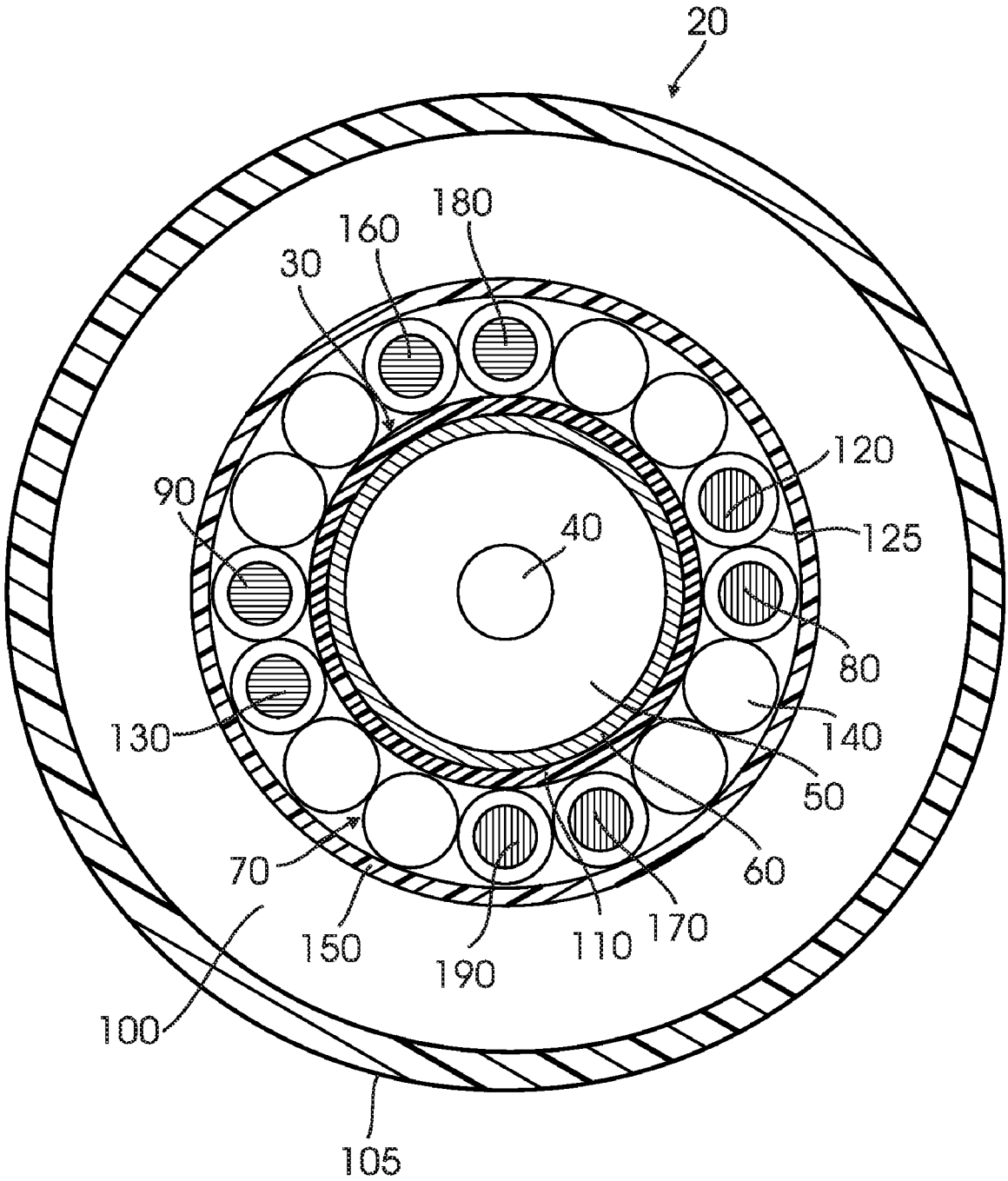
FIG. 4 is a cross-sectional drawing of still another embodiment of the invention herein.

The cable can be constructed with any number of pairs of outer conductors. For example, FIG. 4 shows still another embodiment of the present invention, wherein the outer section 70 of the cable 20 further comprises a third pair of outer conductors and a fourth pair of outer conductors. The third pair of outer conductors comprises a fifth outer conductor 160 and a sixth outer conductor 170. The fourth pair of outer conductors comprises a seventh outer conductor 180 and an eighth outer conductor 190. Preferably, each of the first, second, third, fourth, fifth, sixth, seventh, and eighth outer conductors is individually insulated with a dielectric 125. The insulated fifth outer conductor 160 and the insulated sixth outer conductor 170 are positioned around the inner section 30 such that the insulated fifth and sixth outer conductors are positioned 180° from each other. Also, the insulated seventh outer conductor 180 and the insulated eighth outer conductor 190 are positioned around the inner section 30 such that the insulated seventh and eighth outer conductors are positioned 180° from each other. In particular, FIG. 4 shows that the insulated third outer conductor 120 is positioned next to the insulated first outer conductor 80, that the insulated fifth outer conductor 160 is positioned around the inner section 30 between the insulated second outer conductor 90 and the insulated third outer conductor 120, and that the insulated seventh outer conductor 180 is positioned next to the insulated fifth outer conductor 160. One or more fillers 140 may be positioned next to the insulated outer conductors 80, 90, 120, 130, 160, 170, 180, and 190 around the inner section 30 to maintain the substantially circular shape of the outer extent of the outer section 70. The insulated outer conductors 80, 90, 120, 130, 160, 170, 180, and 190 and the fillers 140 may be located parallel to the central axis of the inner section 30. In another embodiment of the present invention, the insulated outer conductors 80, 90, 120, 130, 160, 170, 180, and 190 and the fillers 140 may spirally wind around the inner section 30 while substantially maintaining their relative positions.

If desired, more number of pairs of outer conductors can be included in the cable. Also, the cable can be constructed with maximum number of pairs of outer conductors allowed in the outer section 70.

Preferably, the inner section 30 of the cable 20 is constructed such that the impedance of the inner section 30 is in the range of approximately 75 ohms to approximately 110 ohms. The following well-known formula commonly used for calculating the characteristic impedance of a coaxial cable can be utilized to determine the impedance of the inner section 30:

$$\text{Impedance}=(138/e\hat{}(1/2))*\log(D/d)$$

Where:

log=logarithm of 10 d=diameter of the core conductor

D=inner diameter of the first shield e=dielectric constant (=1 for air)

Figure 5:
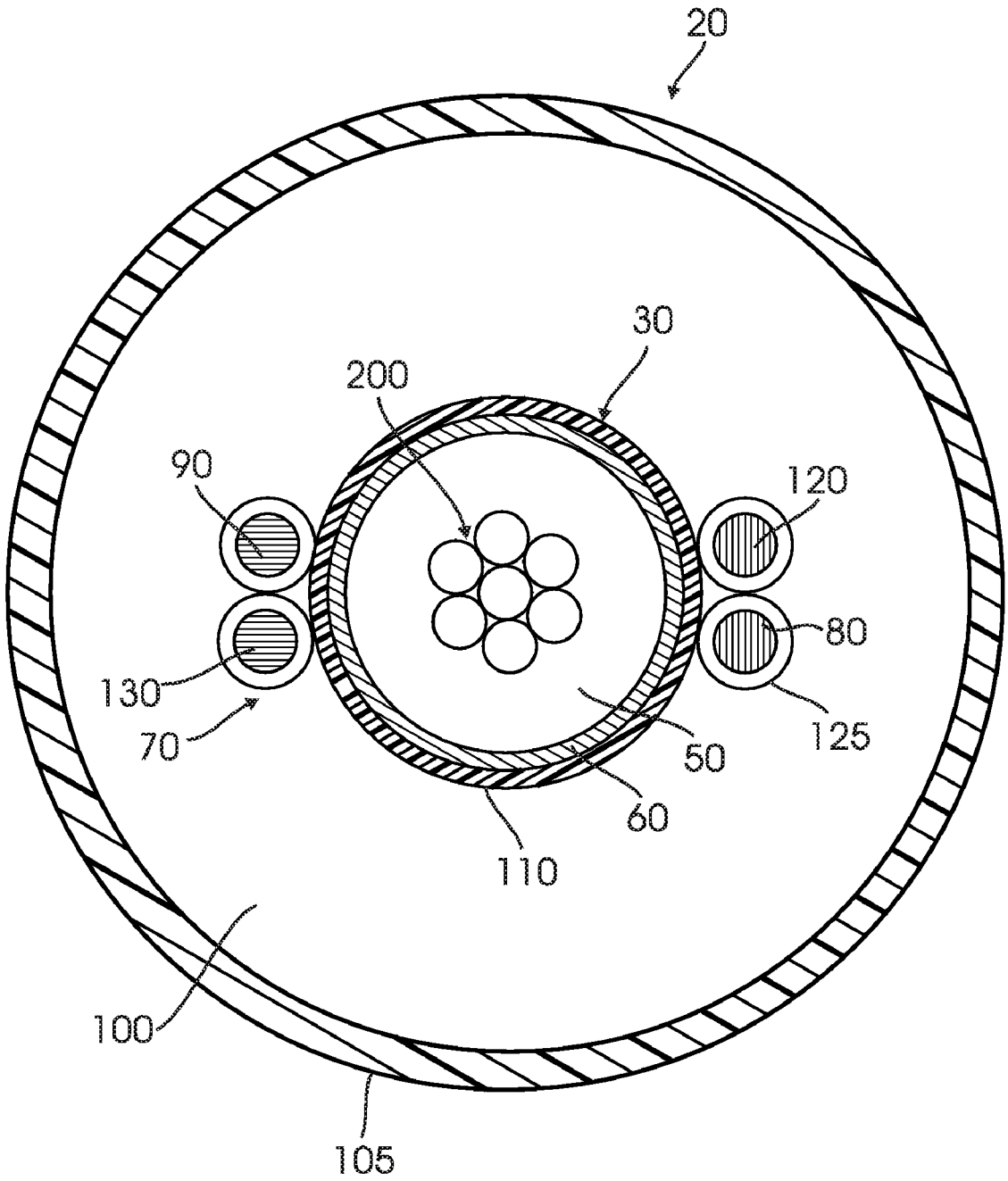
FIG. 5 is a cross-sectional drawing of still another embodiment of the invention herein.

The cable 20 can comprise a bundle of core conductors 200 in the inner section 30, as illustrated in FIG. 5, instead of a single core conductor 40. The bundle of core conductors 200 are arrayed in parallel along the core axis of the cable 20 and surrounded by a common insulation 50. The number of core conductors in the bundle 200 can vary, and the outer extent of the bundle of core conductors 200 maintains substantially circular in shape. Core conductors of the bundle 200 may have substantially the same cross-sectional shape and size. Also, core conductors of the bundle 200 may be the same type of conductors. In another embodiment, the bundle of core conductors 200 may be any combination of different types of conductors.

The insulation 50 is surrounded by a first shield 60. The inner section 30 may further comprise a second shield 110, which surrounds the first shield 60.

Preferably, the inner section 30 of the cable 20 is constructed such that the impedance of the inner section 30 is in the range of approximately 75 ohms to approximately 110 ohms. The following formula can be used for determining the impedance of the inner section 30:

$$\text{Impedance}=(138/e\hat{}(1/2))*\log(D/d)$$

Where:

log=logarithm of 10 d=diameter of the outer extent of the bundle of core conductors

D=inner diameter of the first shield e=dielectric constant (=1 for air)

The remaining structure of the cable 20 comprising a bundle of core conductors 200 can be constructed in the same way as the structure of the outer section 70, jacket 100, and third shield 150 of the cable comprising a single core conductor 40.

The core conductors and the outer conductors in the embodiments of the present invention can be made of oxygen-free copper. The core conductors and the outer conductors can also be made of any other conductive material known in the art.

The insulations 50 and 125, also known as a dielectric, can be made of a material suitable for cable insulation such as nitrogen-injected foamed polyethylene, polyethylene, polypropylene, fluoropolymer, cross-linked polyethylene, rubber, and other similar materials; many insulation materials also contain more than one type of additive such as a flame retardant agent and a mildew-proofing agent.

Each of the first shield 60, the second shield 110, and the third shield 150 can be made of conductive PE, thin copper wires that are braided together, or any other suitable material. When both the first shield 60 and the second shield 110 are used in the cable 20, the first shield 60 may be made of conductive PE, and the second shield 110 can be made of thin copper wires that are braided together around the first shield 60. Any other combinations of the shields are also possible.

The jacket 100 may comprise one or more materials from a list including PVC, polyester, PTFE, PE, and any other suitable materials. For example, the jacket 100 may comprise a layer of PVC that is encased by a polyester sheath 105.

The filler 140 may be comprised of a single dielectric material or may be a composite of at least two dielectrics. Suitable dielectrics include PTFE, PE and PVC.

While the said detailed description elaborates workable embodiments of the improved structure of a cable herein, the said embodiments shall not be construed as a limitation on the patented scope and claims of the present invention and, furthermore, all equivalent adaptations and modifications based on the technological spirit of the present invention shall remain protected within the scope and claims of the invention herein.

What is claimed is:

1. A cable comprising:

an inner section including a core conductor having a central axis, insulation, and a first shield, the core conductor being surrounded by the insulation, the insulation being surrounded by the first shield;

an outer section including at least a first outer conductor and at least a second outer conductor, said first and second outer conductors located parallel to the axis of the inner section and such that the outer conductors are located 180° from each other; and a jacket enclosing the inner section and the outer section, wherein the impedance of the inner section is in the range of approximately 75 ohms to approximately 110 ohms.

2. The cable of claim 1 wherein the outer conductors spirally winding around the inner section while maintaining their respective positions of 180° from each other.

3. The cable of claim 1, wherein the core conductor and the outer conductors are made of oxygen-free copper.

4. The cable of claim 1, wherein the first shield is made of conductive PE.

5. The cable of claim 1, wherein the first shield is made of thin copper wires, the thin copper wires being braided together around the insulation.

6. The cable of claim 1, wherein the jacket comprises at least one of the materials from a list including: PVC; and polyester.

7. The cable of claim 1, wherein the inner section further comprises a second shield, the first shield being surrounded by the second shield.

8. The cable of claim 7, wherein the first shield is made of conductive PE and the second shield is made of thin copper wires, the thin copper wires being braided together around the first shield.

9. The cable of claim 1, wherein each of the outer conductors is insulated.

10. The cable of claim 9, wherein the outer section further comprises a second pair of outer conductors comprising a third outer conductor and a fourth outer conductor, each of the third outer conductor and the fourth outer conductor being insulated, the insulated third outer conductor positioned around the inner section between the insulated first outer conductor and the insulated second outer conductor, the insulated fourth outer conductor positioned 180° from the insulated third outer conductor, the insulated first and second outer conductors spirally winding around the inner section while maintaining their respective positions of 180° from each other, the insulated third and fourth outer conductors spirally winding around the inner section while maintaining their respective positions of 180° from each other as well as substantially maintaining relative positions of the insulated first, second, third, and fourth outer conductors.

11. The cable of claim 10, wherein the outer section further comprises at least one filler positioned next to any of the insulated outer conductors, the filler spirally winding around the inner section while maintaining its relative position to the insulated outer conductors.

12. The cable of claim 11 further comprising a third shield surrounding the outer section, the third shield being surrounded by the jacket.

13. The cable of claim 12, wherein the insulated third outer conductor is positioned next to the insulated first outer conductor.

14. The cable of claim 13, wherein the outer section further comprises a third pair of outer conductors comprising a fifth outer conductor and a sixth outer conductor, each of the fifth outer conductor and the sixth outer conductor being insulated, the insulated fifth outer conductor positioned around the inner section between the insulated second outer conductor and the insulated third outer conductor, the insulated sixth outer conductor positioned 180° from the insulated fifth outer conductor, the insulated fifth and sixth outer conductors spirally winding around the inner section while maintaining their respective positions of 180° from each other as well as substantially maintaining relative positions of the insulated first, second, third, fourth, fifth, and sixth outer conductors.

15. The cable of claim 14, wherein the outer section further comprises a fourth pair of outer conductors comprising a seventh outer conductor and an eighth outer conductor, each of the seventh outer conductor and the eighth outer conductor being insulated, the insulated seventh outer conductor positioned next to the insulated fifth outer conductor, the insulated eighth outer conductor positioned 180° from the insulated seventh outer conductor, the insulated seventh and eighth outer conductors spirally winding around the inner section while maintaining their respective positions of 180° from each other as well as substantially maintaining relative positions of the insulated first, second, third, fourth, fifth, sixth, seventh, and eighth outer conductors.

16. The cable of claim 15, wherein the outer section further comprises at least one filler positioned next to any of the insulated outer conductors, the filler spirally winding around the inner section while maintaining its relative position to the insulated outer conductors.

17. The cable of claim 16 further comprising a third shield surrounding the outer section, the third shield being surrounded by the jacket.

18. A cable comprising:

an inner section comprising a bundle of core conductors, insulation, and a first shield, the bundle of core conductors being surrounded by the insulation, the insulation being surrounded by the first shield;

an outer section comprising a first pair of outer conductors comprising a first outer conductor and a second outer conductor, the outer conductors positioned around the inner section such that the outer conductors are positioned 180° from each other, the outer conductors spirally winding around the inner section while maintaining their respective positions of 180° from each other; and a jacket enclosing the inner section and the outer section, wherein the impedance of the inner section is in the range of approximately 75 ohms to approximately 110 ohms.

19. The cable of claim 18, wherein the bundle of core conductors comprises at least two different types of conductors.

20. The cable of claim 18, wherein the outer section further comprises a second pair of outer conductors comprising a third outer conductor and a fourth outer conductor, each of the first, second, third, and fourth outer conductors being individually insulated, the insulated third outer conductor positioned around the inner section between the insulated first outer conductor and the insulated second outer conductor, the insulated fourth outer conductor positioned 180° from the insulated third outer conductor, the insulated third and fourth outer conductors spirally winding around the inner section while maintaining their respective positions of 180° from each other as well as substantially maintaining relative positions of the insulated first, second, third, and fourth outer conductors.

* * * * *